United States Patent [19]

Fushiya et al.

[11] Patent Number: 5,018,314

[45] Date of Patent: May 28, 1991

[54] SANDER

[75] Inventors: Fusao Fushiya; Shinobu Yamaguchi, both of Anjo, Japan

[73] Assignee: Makita Electric Works, Ltd., Anjo, Japan

[21] Appl. No.: 533,812

[22] Filed: Jun. 6, 1990

[30] Foreign Application Priority Data

Jun. 8, 1989 [JP] Japan ..... 1-67093[U]
Apr. 27, 1990 [JP] Japan ..... 2-46027[U]

[51] Int. Cl.[5] ..... B24B 23/03
[52] U.S. Cl. ..... 51/170 MT
[58] Field of Search ..... 51/170 MT, 170 R, 170 T, 51/134.5 R, 177, 174; 188/379, 380

[56] References Cited

U.S. PATENT DOCUMENTS 2,484,995 10/1949 Harstick ..... 51/170 R
4,759,152 7/1988 Berger et al. ..... 51/170 MT

FOREIGN PATENT DOCUMENTS 1085718 7/1954 France ..... 51/170 MT

*Primary Examiner*—Roscoe V. Parker
*Attorney, Agent, or Firm*—Dennison, Meserole, Pollack & Scheiner

[57] ABSTRACT

A sander has a body, a motor mounted on the body, and a pad driven by the motor. A mechanism is interposed between the motor and the pad for transmitting the rotational motion of the motor to the paid in such a manner that the pad can perform a dual action including an orbital motion and a rotational motion. A resilient member is mounted on the body. The resilient member serves to contact the pad so as to produce frictional resistance against the rotation of the pad.

5 Claims, 5 Drawing Sheets

SANDER

BACKGROUND OF THE INVENTION

1. Field of the invention

This invention relates to a sander, and more particularly to a sander having a pad for mounting an abrasive sheet which performs a dual motion including an orbital motion and a rotational motion.

2. Description of the prior art

In a typical sander, there is provided a mechanism for a pad to perform a dual motion including an orbital motion and a rotational motion. Such sanders are disclosed, for example, in Japanese Utility Model Publication No. 58-41084 and Japanese Laid-Open patent publication No. 62-297066. In such construction, the pad is eccentrically mounted on a rotary shaft of a motor through a bearing. The pad can freely rotate relative to the rotary shaft through its orbital motion. When the pad is rotated without load, its rotational speed increases until substantially the same speed as that of the rotary shaft or the motor.

In order to obtain an excellent finished surface of a work, the motor may be rotated at high speed so that the pad may be rotated also at high speed. However, when the pad is rotated at high speed, abrasive sheet such as sandpaper may be scattered by a centrifugal force. Further, since the pad is idled at high speed from the beginning, the work is abruptly abraded when the pad is pressed thereon, so that the finished surface becomes rather rough.

Further in the typical sander, the bearing is eccentrically mounted on a rotary shaft of a motor, while a shaft rotatably supported by the bearing is fixed to the pad. In this arrangement, however, it is necessary to include another shaft other than the rotary shaft. Further, a bearing support member of large diameter having a recess for mounting the bearing has to be integrally formed with or fixed to the rotary shaft. Therefore, the number of parts of the sander increases, and construction around the rotary shaft becomes large. Thus, the whole construction of the sander becomes large and an operation for assembling the parts is complicated.

SUMMARY OF THE INVENTION

It is, accordingly, an object of the present invention to provide a sander in which the idling speed of a pad can be maintained at a speed lower than that of a motor so as to prevent scattering of an abrasive sheet mounted on the pad and to also prevent abrupt abrasion of the work when the pad is pressed on the work.

It is another object of the present invention to provide a sander which can be constructed by using a reduced number of parts and which includes a simple construction around a rotary shaft so as to permit simple construction of the whole sander and to permit easy assembling of the sander.

According to the present invention, there is provided a sander comprising a body, a motor mounted on the body and having a rotary shaft, a pad drivingly connected to the rotary shaft of the motor, a mechanism interposed between the motor and the pad for transmitting the rotation of the motor to the pad in such a manner that the pad can perform a dual motion including an orbital motion and a rotational motion, and a resilient member mounted on the body and adapted to contact the pad so as to produce frictional resistance against the rotation of the pad.

Preferably, the resilient member is a leaf spring. The leaf spring is mounted on the body in a cantilever manner. The free end of the leaf spring is pressed on a peripheral surface of the pad in a direction substantially toward the central portion of the pad. The free end may be pressed on the pad during a part of the orbital motion of the pad.

The mechanism for transmitting the rotation of the motor to the pad includes an eccentric shaft disposed on one end of the rotary shaft of the motor and a bearing mounted substantially on the central portion of the pad for rotatably supporting the eccentric shaft.

The invention will become more fully apparent from the claims and the description as it proceeds in connection with the drawings.

DETAILED DESCRIPTION OF THE PREFERRED EMBODIMENT

Figure 1:
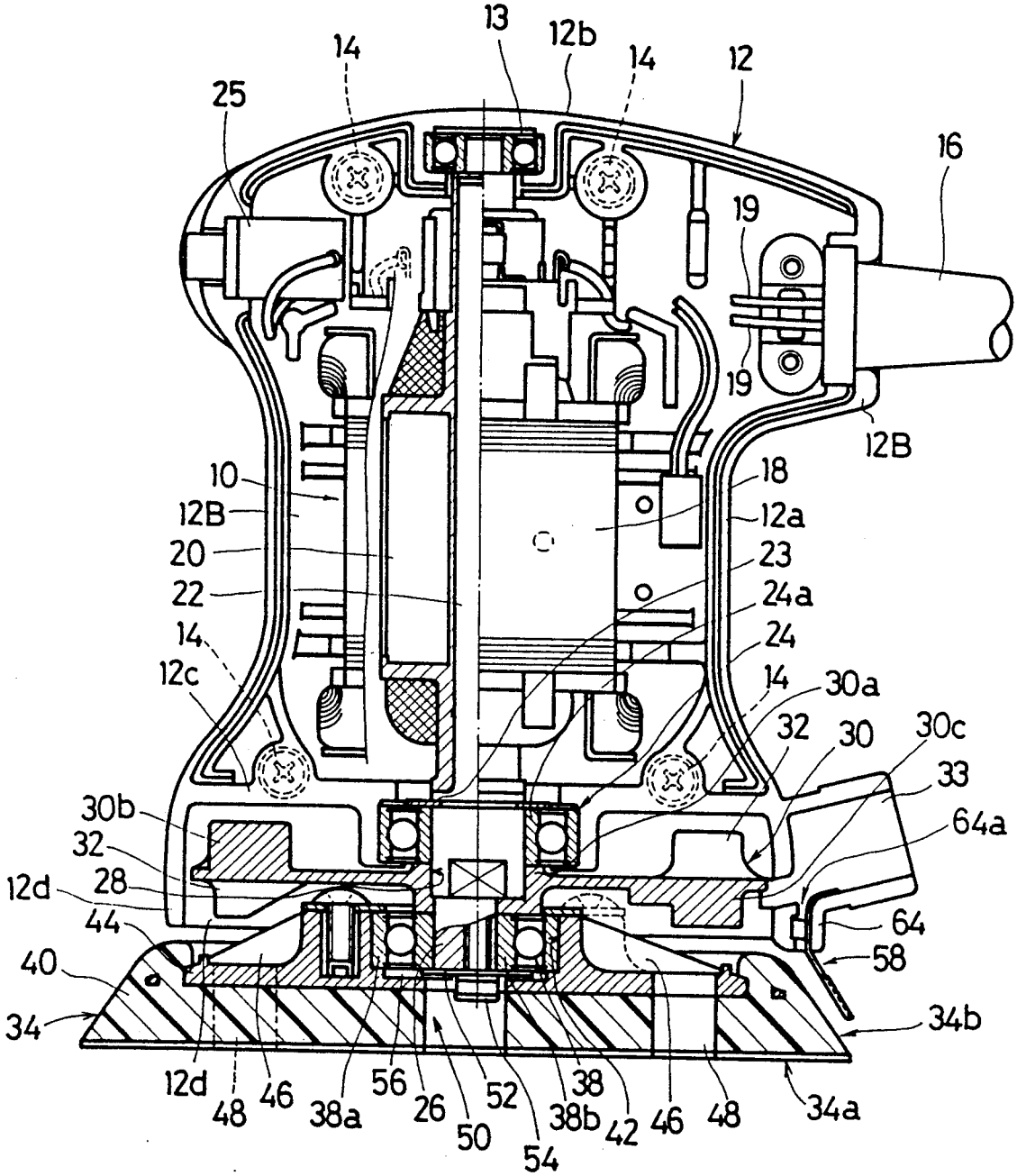
FIG. 1 is a vertical sectional view of a sander according to the present invention.
Figure 2:
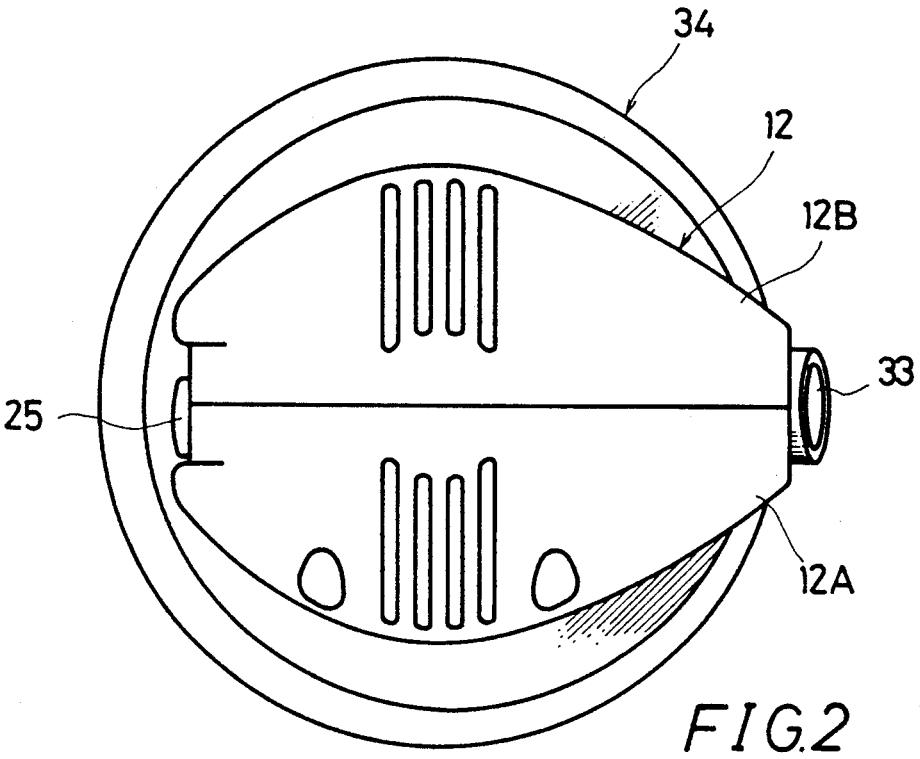
FIG. 2 is a plan view of FIG. 1.
Figure 3:
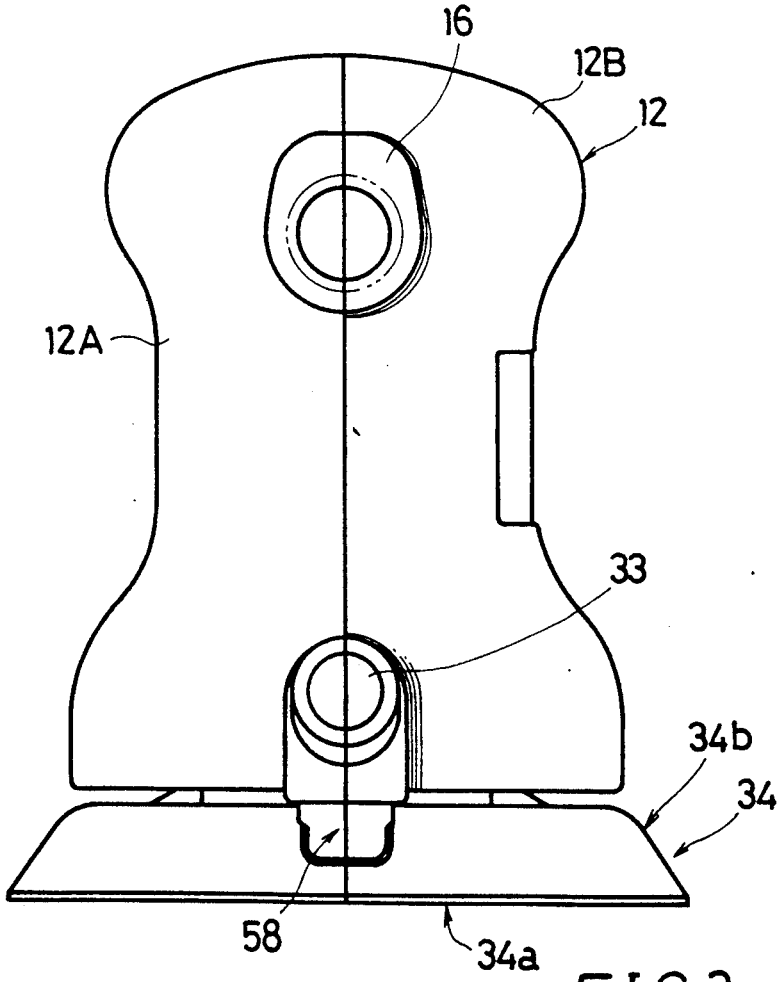
FIG. 3 is a front view of FIG. 1.

Referring to FIG. 1, there is shown a vertical sectional view of a sander which is called "orbital sander". The sander includes a hollow body 12 accommodating a motor 10. As shown in FIGS. 2 and 3, the body 12 is comprised of a pair of complementary mating halves 12A and 12B which are detachably secured by screws 14 shown in FIG. 1.

The motor 10 is vertically disposed at the central portion of the body 12 and includes a field coil 18 supported by a side wall **12*a* of the body 12 and an armature 20 spaced apart from the field coil 18 at a suitable distance in a radial direction. The upper end of a rotary shaft 22 or a shaft of the armature 20 is supported by a bearing 13 mounted on an upper wall 12*b* of the body 12. The lower end of the rotary shaft 12 is supported by a bearing 24 mounted on the lower surface of a bottom wall 12*c* of the body 12. An E-ring 23 is mounted on a part of the rotary shaft 22 for engagement with the upper surface of an inner race 24*a* of the bearing 24. A bushing 16 is mounted on the upper portion of the body 12 at the front side thereof. Conducting wires 19 having at one end a plug (not shown) are inserted through the bushing 16 for supplying electric power to the field coil 18 and the armature 20 through a brush (not shown). A manually operable switch 25 is mounted on a part of the body 12 for selectively interrupting or permitting supply of electric power to the field coil 18 and the armature 20**.

Figure 4:
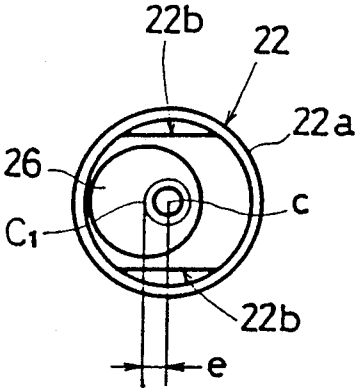
FIG. 4 is a bottom view of a rotary shaft shown in FIG. 1.

The rotary shaft 22 extends through the bearing 24 to the position below the bottom wall **12*c*. An eccentric shaft 26 is integrally formed with the lower end of the rotary shaft 22. As shown in FIG. 4, the center C1 of the eccentric shaft 26 is spaced apart from the center C of the rotary shaft 22** at a distance e.

Figure 6:
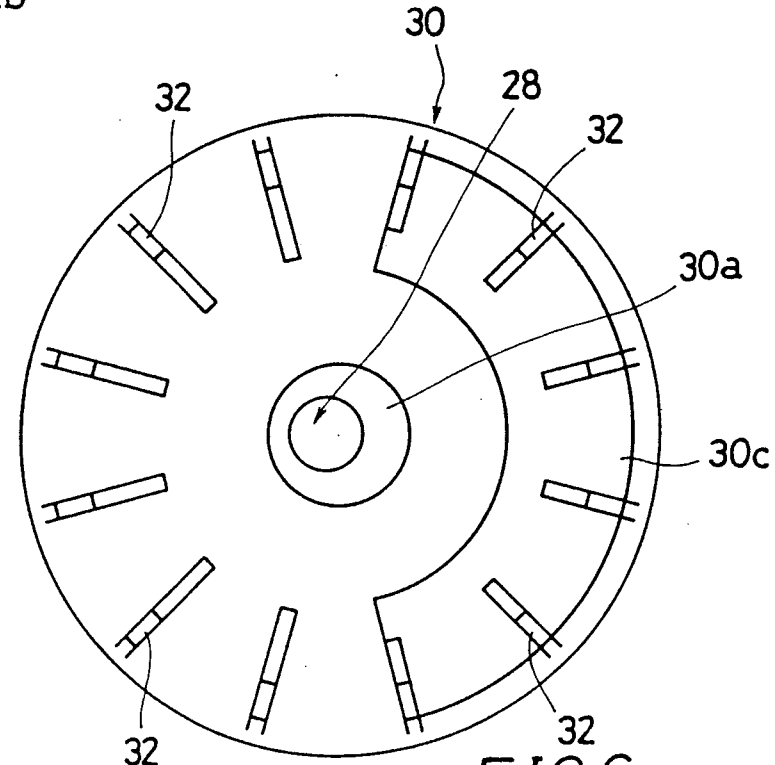
FIGS. 5 and 6 are a plan view and a bottom view of a fan shown in FIG. 1, respectively.
Figure 5:
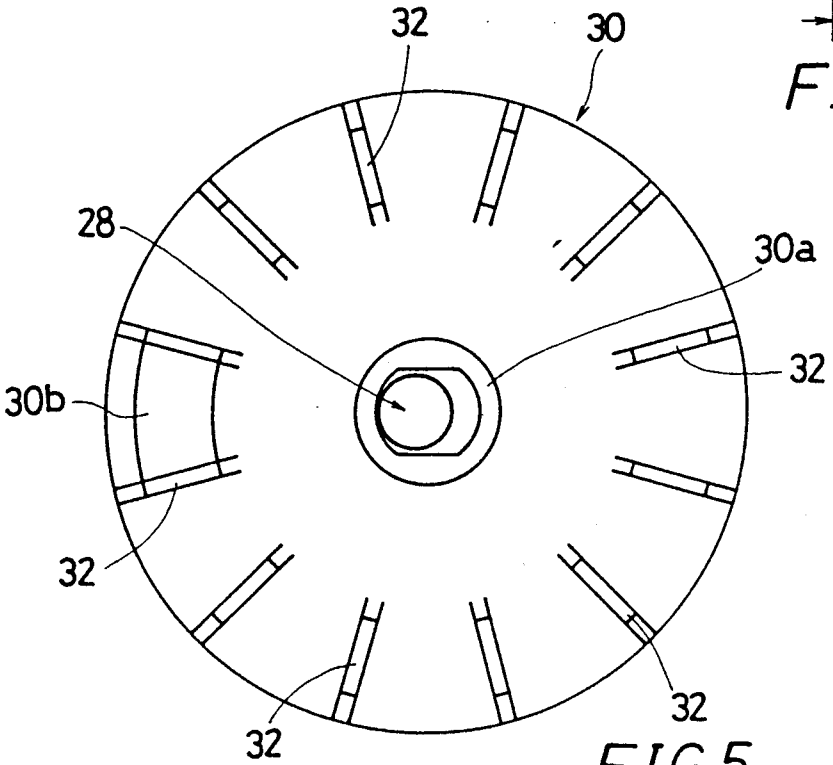

A circular fan 30 is fitted on the lower portion of the rotary shaft 22 through a boss 30*a* formed at the central portion thereof. The boss 30*a* includes a stepped bore 28 corresponding to the lower portion of the rotary shaft 22 and the upper portion of the eccentric shaft 26. As shown in FIG. 4, the lower end of the rotary shaft 22 has opposite sides 22*b* chamfered in a radial direction, so that the rotation of the fan 30 relative to the rotary shaft 22 is reliably prevented. As shown in FIGS. 5 and 6, the circular fan 30 includes on both upper and lower surfaces thereof a plurality of fins 32 integrally formed at the peripheral portion. The fins 32 formed on each surfaces are equally spaced apart from each other in a circumferential direction. The circular fan 30 further includes thick portions 30*b*, 30*c* formed on the peripheral portion of the upper and lower surfaces thereof, respectively The thick portions 30*b*, 30*c* act as balance weights for compensating imbalance of rotation caused by the eccentric shaft 26 when the rotary shaft 22 is rotated.

The body 12 includes a skirt portion 12*d* extending downwardly from the side wall 12*a* and below the bottom wall 12*c*. The skirt portion 12*d* surrounds the fan 30 and includes a scob outlet 33 opening outwardly and inwardly of the the skirt portion 12*d* in a radial direction thereof.

Figure 7:
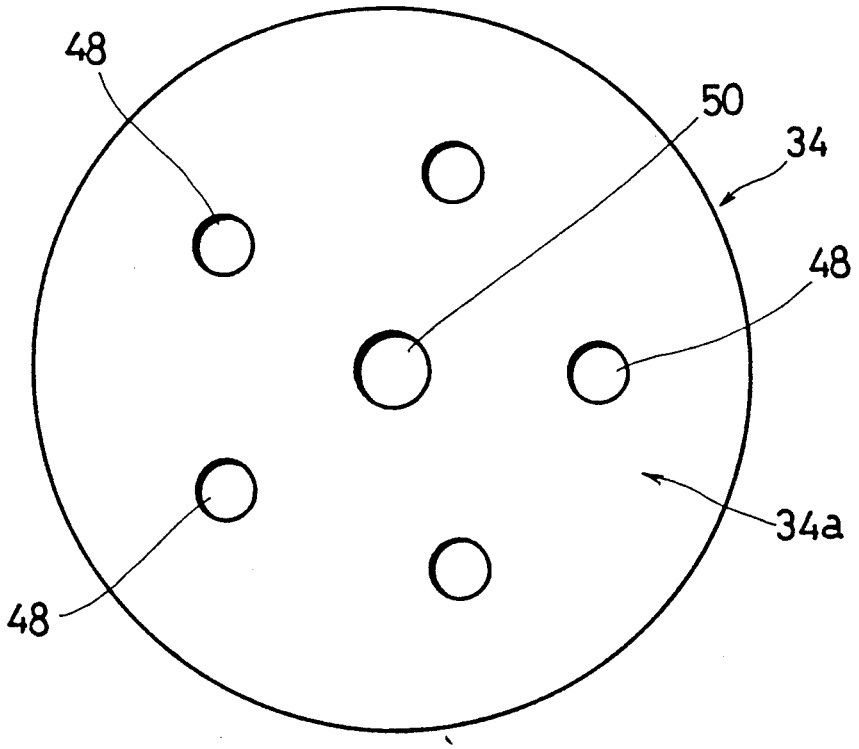
FIG. 7 is a bottom view of a pad shown in FIG. 1.

A circular pad 34 is positioned below the skirt portion 12*d* of the body 12 and is spaced apart therefrom at a small distance. The pad 34 is mounted on the eccentric shaft 26 by a bearing 38 and includes a base portion 40 having an under surface 34*a* for mounting an abrasive sheet (not shown) and a bearing support portion 44 having a circular recess 42 for fixedly receiving the bearing 38. Reinforcement ribs 46 are integrally formed with the upper surface of the bearing support portion 44 in opposing relation to the fan 30. The ribs 46 are spaced apart from each other at a suitable distance in a circumferential direction. As shown in FIG. 7, the pad 34 further has a plurality of suction holes 48 extending vertically therethrough and spaced equally apart from each other in a circumferential direction. Each suction hole 48 is positioned between suitable two adjacent ribs 46. Additionally, the pad 34 has a central hole 50 extending downwardly from the circular recess 42.

The bearing 38 is assembled to the rotary shaft 22 as will be hereinafter explained. In the assembled state shown in FIG. 1, an outer race 38*a* of the bearing 38 is fitted within the circular recess 42 of the pad 34. On the other hand, the inner race 38*b* abuts on the lower end of the boss 30*a* of the fan 30 at the upper surface thereof. The eccentric shaft 26 is inserted within the inner race 38*b*. The lower end surface of the eccentric shaft 26 and the lower surface of the inner race 38*b* are flush with each other A washer 52 is disposed on the lower surfaces of both the inner race 38*b* and the eccentric shaft 26 and is secured to the eccentric shaft 26 by a screw 54, so that axial position of the fan 30 and the bearing 38 is maintained relative to the rotary shaft 22. The screw 54 can be tightened by inserting a driver (not shown) into the central hole 50 from the lower side of the pad 34. Further, the bearing support portion 44 of the pad 34 includes an additional recess 56 which has a diameter slightly smaller than that of the circular recess 42 and is joined thereto, so that the washer 52 is positioned within the additional recess 42.

Figure 8:
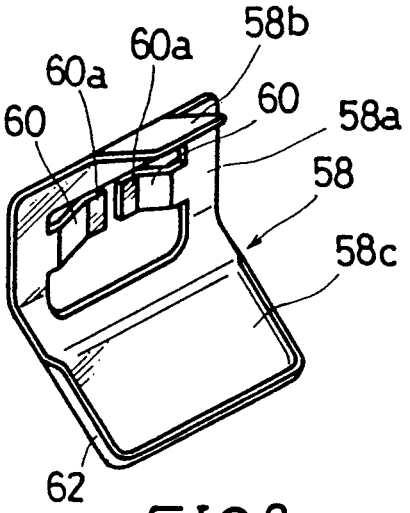
FIG. 8 is a perspective view of a leaf spring shown in FIG. 1.

A leaf spring 58 is mounted on the lower part of the scob outlet 33 adjacent the fan 30 and extends downwardly from the outlet 33 in a cantilever manner. The leaf spring 58 is made of a flat plate by punching and bending. As shown in FIG. 8, the leaf spring 58 includes a base portion 58*a*, an upper portion 58*b* extending upwardly and bent from the base portion 58*a*, and a lower portion 58*c* extending downwardly from the base portion 58*a* and bent in the same direction as the upper portion 58*b*. The base portion 58*a* has n pair of wings 60 which are bent in direction opposite to that of the upper portion 58*b* and the lower portion 58*c* and which are opposed to each other in a horizontal plane. The end 60*a* or the free end of each wing 60 is further bent in a direction parallel to the base portion 58*a*. The lower portion 58*c* has a curved edge 62 in the same direction as that of the lower portion 58*c* substantially all over the peripheral portion thereof.

The leaf spring 58 is mounted on the scob outlet 33 as will be hereinafter explained with reference to FIGS. 9 and 10.

Figure 9:
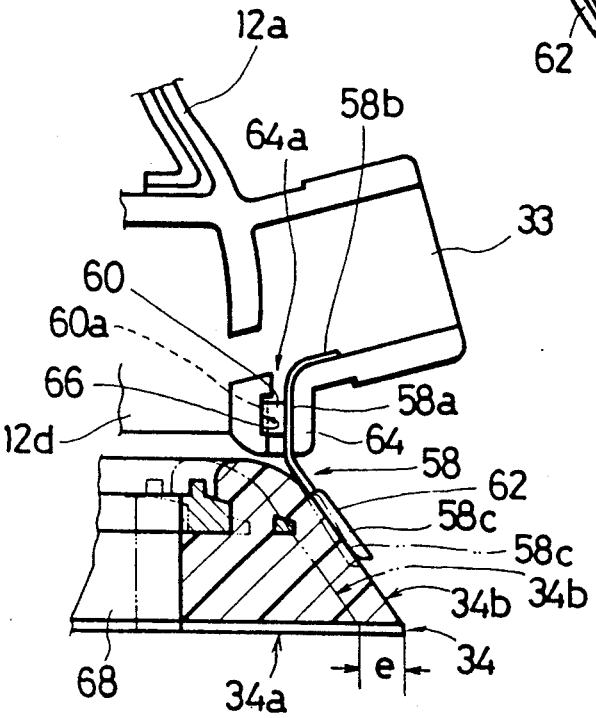
FIG. 9 is a partly enlarged view of FIG. 1 showing the leaf spring pressing on the pad.
Figure 10:
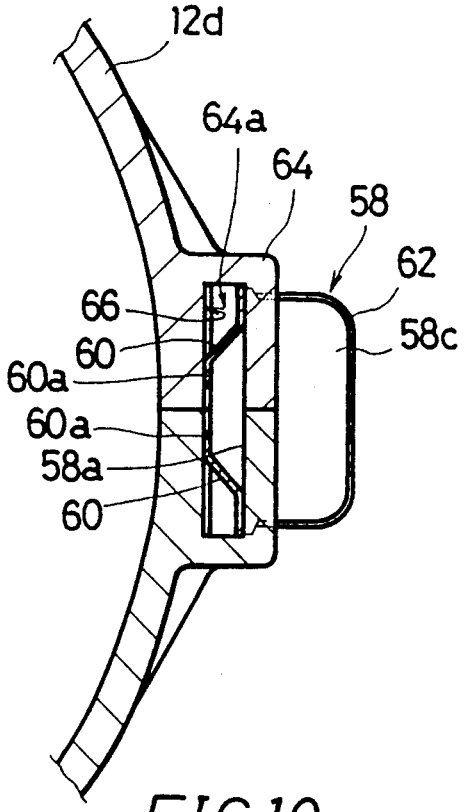
FIG. 10 is a horizontal sectional view of a part of a body to which the leaf spring is mounted.

As shown in FIG. 9, a spring mounting portion 64 of the scob outlet 33 includes an opening 64*a* extending vertically therethrough. The opening 64*a* is rectangular in plan view as shown in FIG. 10. The leaf spring 58 is mounted on the spring mounting portion 64 with the base portion 58*a* positioned within the opening 64*a*. The opening 64*a* is formed with a recess 66 within which the ends 60*a* of the wings 60 engage. At the state shown in FIG. 10, each wing 60 is resiliently bent, so that the end 60*a* is pressed on the bottom of the recess 66, while the base portion 58*a* is pressed on the inner surface of the opening 64*a* opposite to the recess 66. Additionally, the width of the base portion 58*a* is substantially the same as that of the opening 64. With this construction, the position of the leaf spring 58 is restrained in a horizontal direction. Further as shown in FIG. 1, the upper portion 58*b* of the leaf spring 58 extends along the inner surface of the scob outlet 33, so that the vertical position of the leaf spring 58 is restrained by such arrangement as well as by the engagement of the wings 60 with the recess 66. The lower portion 58*c* extends downwardly from the scob outlet 33 in parallel to the peripheral surface 34*b* of the pad 34. As shown in FIG. 9, the position of the lower portion 58*c* is so determined that it abuts on the peripheral surface 34*b* of the pad 34 in a direction substantiaaly toward the center of the rotation of the pad 34 and is flexed when the pad 34 has been moved rightwardly in FIG. 1 with an orbital motion which will be hereinafter explained. The lower portion 58*c* has at the peripheral portion thereof the curved edge 62, so that the peripheral surface 34*b* of the pad 34 is prevented from being damaged by the lower portion 58*c*.

In operation, when the motor 10 is started by turning on the switch 25, the rotary shaft 22 is rotated with the eccentric shaft 26, so that the eccentric shaft 26 eccentrically rotates according to the distance e or the eccentric radius as shown in FIG. 4. Since the pad 34 is rotatable relative to the eccentric shaft 26 by the bearing 38 and the center of rotation of the pad 34 coincides with the center C1 of the eccentric shaft 26, the center of the pad 34 is moved along the orbit of the center C1 of the eccentric shaft 26 (hereinafter called an orbital motion). Thus, the pad 34 can be moved with the orbital motion as well as the rotational motion relative to the eccentric shaft 26 FIG. 1 shows the pad 34 in its most leftward position by the orbital motion.

In the practical operation, the abrasive sheet is mounted on the lower surface 34*a* of the pad 34, and the abrasive sheet is pressed on the work by holding down the upper portion of the body 12 with one hand of the operator, so that the work is abraded by the abrasive sheet with the pad 34 performing a dual motion incuding the orbital motion and the rotational motion.

As explained above, when the pad 34 is moved to its most rightward position shown in FIG. 9 by the orbital motion, the lower portion 58*c* of the leaf spring 58 abuts on the peripheral surface 34*b* of the pad 34 so as to produce frictional force against the rotation. The rotational speed of the pad 34 normally reaches the speed substantially the same as the rotational speed of the rotary shaft 22 of the motor 10 when the pad 34 is rotated without load or idling. However, in this embodiment, the frictional force produced between the leaf spring 58 and the pad 34 prevents the rotational speed of the pad 34 from increasing to the rotational speed of the rotary shaft 22, or the rotational speed of the pad 34 is maintained at lower speed than that of the rotary shaft 22.

Thus, even if the rotary shaft 22 rotates at high speed, the idling speed of the pad 34 is maintained at relatively low speed. For example, in the case that the rotational speed of the rotary shaft 22 is 12,000 rpm, the idling speed of the pad 34 can be lowered to about 1,500 rpm.

For the above reason, the abrasive sheet is prevented from scattering which may be caused when the pad 34 rotates at high speed. Additionally, the work to be abraded is prevented from being abruptly abraded so that an excellent finished surface can be obtained.

Further, when the pad 34 is pressed on the work so as to abrade the work, the rotational speed of the pad 34 is further lowered. In the case that the rotational speed of the shaft 22 is 12,000 rpm as described above, the rotational speed of the pad 34 is lowered to about 400 rpm. Such rotational speed of the loaded pad 34 is the same as the rotational speed when the pad 34 is loaded without developing the frictional force by the leaf spring 58 since a rotational resistance of the bearing 38 as well as the frictional force between the work and the abrasive sheet increases when the force is applied on the body 12 downwardly toward the work at the sanding operation, so that the resistance by the pad 34 can be negligible as compared with these forces.

Further, although in this embodiment the leaf spring 58 contacts the pad 34 only at the timing when the pad 34 is moved to a position immediately before the most rightward position in FIG. 1, the leaf spring 58 may be arranged to contact the pad 34 throughout the orbital motion of the latter.

Meanwhile, as the rotary shaft 22 rotates, the fan 30 is rotated therewith, so that the air flows into the space S within the skirt portion 12*d* from the bottom of the pad 34 through the suction holes 48 formed vertically in the pad 34, and subsequently the air flows out of the skirt portion 12*d* through the scob outlet 33. Such flow of air is accelerated with the aid of the ribs 46 of the pad 34. With this air flow, abraded scobs of the work produced between the pad 34 and the work is discharged through the scob outlet 33. The flow of air also cools the pad 34, so that the cooling of the pad 34 and the cleaning of the surface of the work can be effectively performed.

Further, in this embodiment, the eccentric shaft 26 is integrally formed with the rotary shaft 22, and the pad 34 does not have any shaft but has only the bearing. Therefore, the construction around the rotary shaft 22 is simplified. Further, the space S can be formed with enough capacity without sacrificing the overall height of the sander, so that the cooling of the pad 34 and discharging of the scobs can be more efficiently performed.

The operation for assembling the pad 34 to the body 12 will now be explained Prior to assembling the pad 34, the bearing 38 is firstly mounted on the pad 34 together with the washer 52. On the other hand, the rotary shaft 22 with the upper and lower bearing including the bearing 24 is mounted on the body 12 so as to partly extend downwardly from the bottom wall 12*c*. The fan 30 is then fitted on the rotary shaft 22 and thereafter, the inner race 38*b* of the bearing 38 previously mounted on the pad 34 is fitted on the eccentric shaft 26. The screw 54 is subsequently tightened by a driver so as to fix the position of the washer 52 to contact both the lower end of the eccentric shaft 26 and the inner race 38*b*. The assembling operation of the pad 34 is thus performed, so that the operation can be performed without using a special tool or without rendering difficult operation.

While the invention has been described with reference to a preferred embodiment thereof, it is to be understood that modifications or variations may be easily made without departing from the spirit of this invention which is defined by the appended claims.

What is claimed is:

1. A sander comprising a body, a motor mounted on said body and having a rotary shaft, a pad for mounting an abrasive sheet for abrading a work, said pad being drivingly connected to said rotary shaft of said motor, a mechanism interposed between said motor and said pad for transmitting the rotation of said motor to said pad in such a manner that said pad can perform a dual motion including an orbital motion and a rotational motion so as to permit rotation of said pad to reach substantially the same speed as the rotational speed of said rotary shaft when said pad is unloaded, and a resilient member mounted on said body and adapted to contact said pad so as to produce frictional resistance against the rotation of said pad so that the rotational speed of said pad is lowered to prevent the abrasive sheet from being scattered or to prevent the work from being abruptly abraded when said pad is pressed on the work.

2. The sander as defined in claim 1 wherein said mechanism for transmitting the rotation of said motor to said pad includes an eccentric shaft disposed on one end of said rotary shaft of said motor and a bearing mounted substantially on the central portion of said pad for rotatably supporting said eccentric shaft.

3. The sander as defined in claim 1 wherein said resilient member is a leaf spring.

4. The sander as defined in claim 1 wherein the leaf spring is mounted on the body in a cantilever manner, the free end of said leaf spring being adapted to be pressed on a peripheral surface of said pad in a direction substantially toward the central portion of said pad.

5. The sander as defined in claim 1 wherein the free end of said leaf spring is pressed on said pad during a part of the orbital motion of said pad.

* * * * *